US008272973B2

(12) United States Patent
Lu

(10) Patent No.: US 8,272,973 B2
(45) Date of Patent: Sep. 25, 2012

(54) GOLF CLUB GRIP

(76) Inventor: Clive S. Lu, Hicksville, NY (US)

( * ) Notice: Subject to any disclaimer, the term of this patent is extended or adjusted under 35 U.S.C. 154(b) by 212 days.

(21) Appl. No.: 12/651,445

(22) Filed: Jan. 1, 2010

(65) Prior Publication Data

US 2011/0165957 A1 Jul. 7, 2011

(51) Int. Cl.
*A68B 53/14* (2006.01)

(52) U.S. Cl. ..... 473/300; 473/549; 473/568

(58) Field of Classification Search ..... 473/300–303, 473/568, 294
See application file for complete search history.

(56) References Cited

U.S. PATENT DOCUMENTS 1,139,843 A * 5/1915 Brown ..... 473/302
2,221,421 A * 11/1940 Curry ..... 473/300
4,592,552 A * 6/1986 Garber ..... 473/293
D355,011 S * 1/1995 Subnick ..... D21/756
5,398,930 A 3/1995 Gibson
5,460,372 A 10/1995 Cook
5,460,375 A * 10/1995 Hardee ..... 473/300
5,671,923 A 9/1997 Huang
813,921 A 9/1998 Huang
5,827,129 A 10/1998 Huang
5,895,329 A * 4/1999 Huang ..... 473/302
5,897,440 A 4/1999 Bae et al.
5,993,327 A * 11/1999 Terril ..... 473/297
6,068,562 A * 5/2000 Hedges ..... 473/409
6,213,891 B1 * 4/2001 Moore ..... 473/300
6,226,836 B1 * 5/2001 Yasui ..... 16/421
6,656,057 B2 12/2003 Manual et al.
6,663,499 B2 * 12/2003 Riseley ..... 473/294
6,709,346 B1 3/2004 Wang
6,718,675 B1 4/2004 Lu
6,817,956 B1 * 11/2004 Dagenais ..... 473/300
6,843,732 B1 * 1/2005 Huang ..... 473/300
6,857,971 B2 * 2/2005 Huang ..... 473/300
6,908,400 B2 * 6/2005 Chu et al. ..... 473/303
6,988,958 B2 * 1/2006 Roelke ..... 473/295
7,025,690 B2 4/2006 Nam
D531,243 S * 10/2006 Davis ..... D21/756
7,458,903 B2 * 12/2008 Wang et al. ..... 473/300
7,461,474 B1 12/2008 Lu et al.
D602,106 S * 10/2009 Stellander ..... D21/756
D602,546 S * 10/2009 Lin ..... D21/756
2001/0041626 A1 * 11/2001 Madelle et al. ..... 473/295
2002/0025858 A1 * 2/2002 Sosin ..... 473/340
2003/0207241 A1 11/2003 Manual et al.
2003/0216192 A1 * 11/2003 Chu ..... 473/300
2004/0063514 A1 * 4/2004 Lane ..... 473/303
2005/0197201 A1 * 9/2005 Schoeninger ..... 473/300
2006/0009304 A1 1/2006 Tremulis et al.
2006/0027313 A1 * 2/2006 Jaw ..... 156/213
2006/0068930 A1 * 3/2006 Chi ..... 473/300

(Continued)

*Primary Examiner* — Stephen L. Blau
(74) *Attorney, Agent, or Firm* — King & Schickli, PLLC

(57) ABSTRACT

A lightweight, oversized grip assembly for a golf club or other sporting equipment includes a first grip element defining an open channel for receiving a gripping end of the golf club or other sporting equipment, and a second grip element dimensioned to match a cross-sectional dimension and a longitudinal dimension of the first grip element. The assembled first grip element and second grip element define a grip having a maximum diameter of up to about 500 mm. The first grip element defines an open channel axially along a longitudinal dimension thereof, having a width and a depth dimensioned to receive substantially an entirety of a thickness of the gripping end. The second grip element defines a substantially planar cover for capturing the base element and the gripping end between the first grip element and the second grip element.

19 Claims, 4 Drawing Sheets

U.S. PATENT DOCUMENTS

2006/0252571 A1* 11/2006 Wang ..... 473/300
2007/0173342 A1* 7/2007 Turnpaugh et al. ..... 473/300
2007/0243940 A1 10/2007 McCree et al.
2008/0176670 A1* 7/2008 Gill et al. ..... 473/300
2011/0053704 A1* 3/2011 Huang ..... 473/300
2011/0111880 A1* 5/2011 Chu et al. ..... 473/303

* cited by examiner 26
12
14
24

26d
28
28

26c 26a
28
28

26e
28
28

28
28
24c

24a

24d

GOLF CLUB GRIP

TECHNICAL FIELD

This invention relates generally to the field of grips for golf clubs and other sporting equipment having a gripping end. In particular, the present invention relates to lightweight oversized grips for articles of sporting equipment having a gripping end, such as putters.

BACKGROUND OF THE INVENTION

The grip of sporting equipment such as golf clubs provides the contact point via which the user controls the club. As is well known in the art, the grip improves user comfort and provides a secure contact between the golf club and the user's hands. Desirably, the grip will provide a suitable compromise between such user comfort and a level of contact which allows the user to "feel" the shot being struck, i.e., to detect that suitable contact between club and ball has been achieved.

For golf clubs such as putters, it is known to provide oversized grips, that is, grips having an external diameter significantly greater than that of a conventional club grip. The advantages touted for oversized grips for putters include improved stability of hands and wrists, thereby transferring control of the putter stroke to larger, more stable muscle groups such as the chest and torso. Further, an oversized grip reduces the tendency to grip the club too strongly during the putting stroke. These features reduce wrist action during the putting stroke, promoting the desired "pendulum" stroke for a putt and allowing greater putting accuracy.

It is also known to provide a putter having a long grip, that is, a grip that is significantly elongated in comparison to a grip of conventional length. Such grips are often associated with a putter having an overall length that is significantly greater than a conventional putter length, such as a "belly putter" or a so-called "long putter." These putter types allow a more upright stance and further reduce wrist action during the putting stroke, again promoting the desired "pendulum" stroke. The long grip also provides the user with multiple options for hand positioning, to achieve the most comfortable grip for the particular user.

It is possible to provide an oversized grip, including an oversized long grip, by simply increasing the size and thickness of a grip of conventional design made of conventional materials such as rubber. However, simply increasing the size of a standard rubber grip correspondingly increases the weight of the grip, and thereby the weight of the club as a whole. This increase in grip weight not only alters the club weight, but also undesirably affects the balance and "feel" of a club such as a putter, making it top-heavy. There is accordingly a need in the art for grips for sporting equipment having gripping ends such as golf clubs, which provide an oversized gripping area without undesirably adding weight or altering club balance and feel.

SUMMARY OF THE INVENTION

In accordance with the purposes of the present invention as described herein, in one aspect there is provided a lightweight, oversized grip assembly for a golf club or other sporting equipment. The grip assembly includes a first grip element defining an open channel for receiving a gripping end of the golf club or other sporting equipment. The assembly further includes a second grip element dimensioned to match a cross-sectional dimension and a longitudinal dimension of the first grip element. The first grip element defines an open channel axially along a longitudinal dimension thereof, the open channel having a width and a depth dimensioned to receive substantially an entirety of a thickness of the gripping end. The second grip element defines a substantially planar cover for capturing the base element and the gripping end between the first grip element and the second grip element. Once assembled, the first grip element and second grip element define a grip having a maximum diameter of up to about 500 mm.

In another aspect, there is provided a lightweight, oversized grip assembly for a golf club or other sporting equipment, having a base element defining a lumen for receiving a gripping end portion of a golf club or other sporting equipment, a first grip element defining an open channel for receiving the base element and gripping end, and a second grip element dimensioned to match a cross-sectional dimension and a longitudinal dimension of the first grip element.

The base element is an elongate sleeve defining a hollow lumen through a longitudinal dimension of the base element, dimensioned to receive the club gripping end snugly therein. The first grip element defines an open channel axially along a longitudinal dimension thereof, the open channel having a width and a depth dimensioned to receive substantially an entirety of a thickness of the base element and the gripping end. The second grip element forms a substantially planar cover, capturing the base element and gripping end between the first and second grip elements. At least one wrapping element, which may be made of any suitable synthetic or natural material, may be provided for wrapping around the assembled gripping end, base element, first grip element, and second grip element to provide a finished grip assembly. An end cap and a grip tip element may be provided, each of which may further include a lip or flange which are disposed on a top surface of the wrapping element.

In still yet another aspect of the invention, a modular, lightweight, elongated, and oversized "long grip" assembly for a putter is provided. The individual elements of the grip assembly are substantially as described above. Specifically, the modular grip assembly includes a plurality of base elements defining a lumen for receiving a gripping end portion of a putter, a plurality of first grip elements defining an open channel for receiving the plurality of base elements and the gripping end, and a plurality of second grip elements dimensioned to match a cross-sectional dimension and a longitudinal dimension of the plurality of first grip elements. Once assembled in sequence, the plurality of base elements, plurality of first grip elements, and plurality of second grip elements define an elongated grip for the putter having a maximum diameter of up to about 500 mm.

In the following description there is shown and described a preferred embodiment of this invention that is illustrative of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain certain principles of the invention. In the drawings.

DETAILED DESCRIPTION OF THE INVENTION

Figure 1:
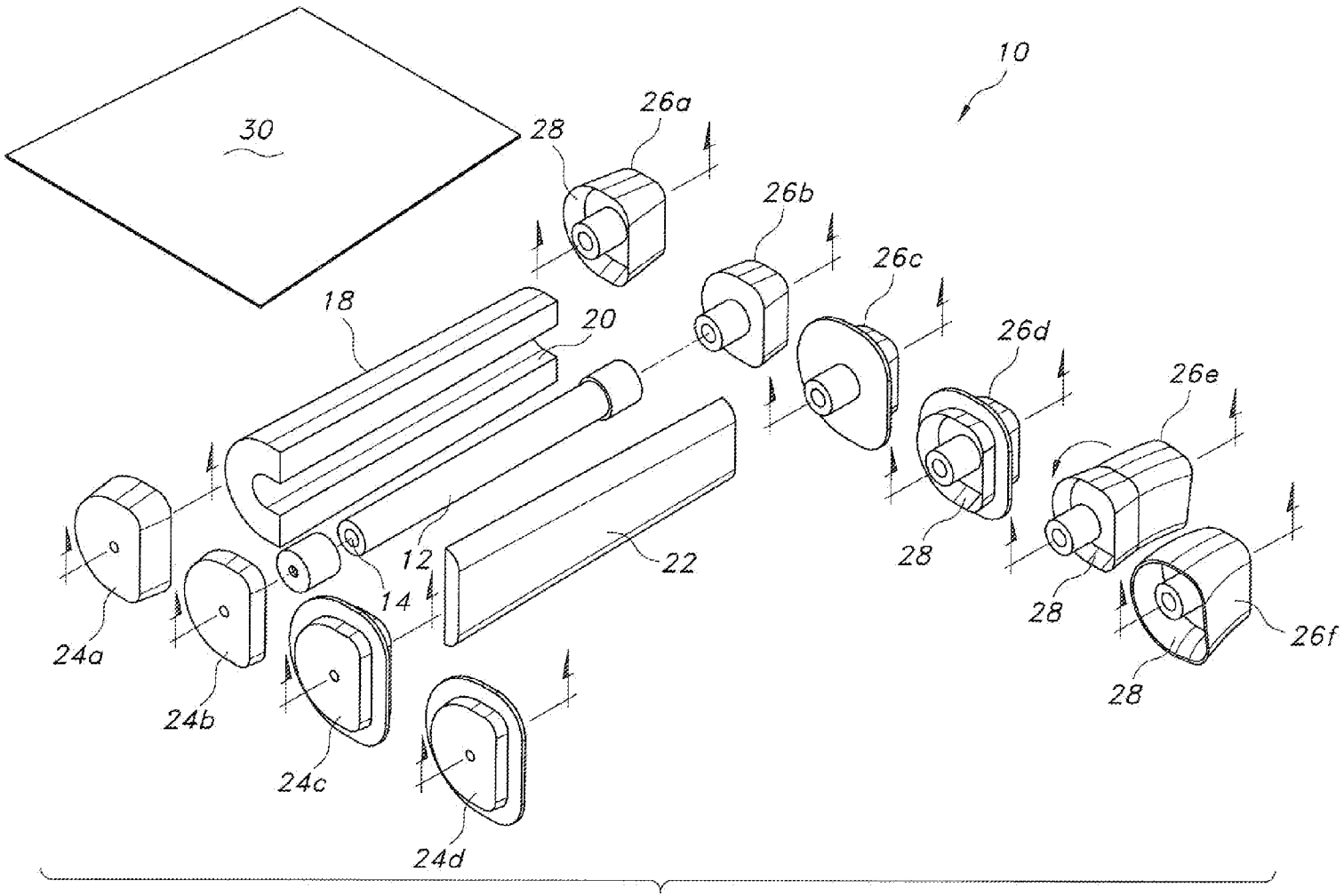
FIG. 1 is an exploded view of a grip in accordance with the present disclosure.
Figure 2:
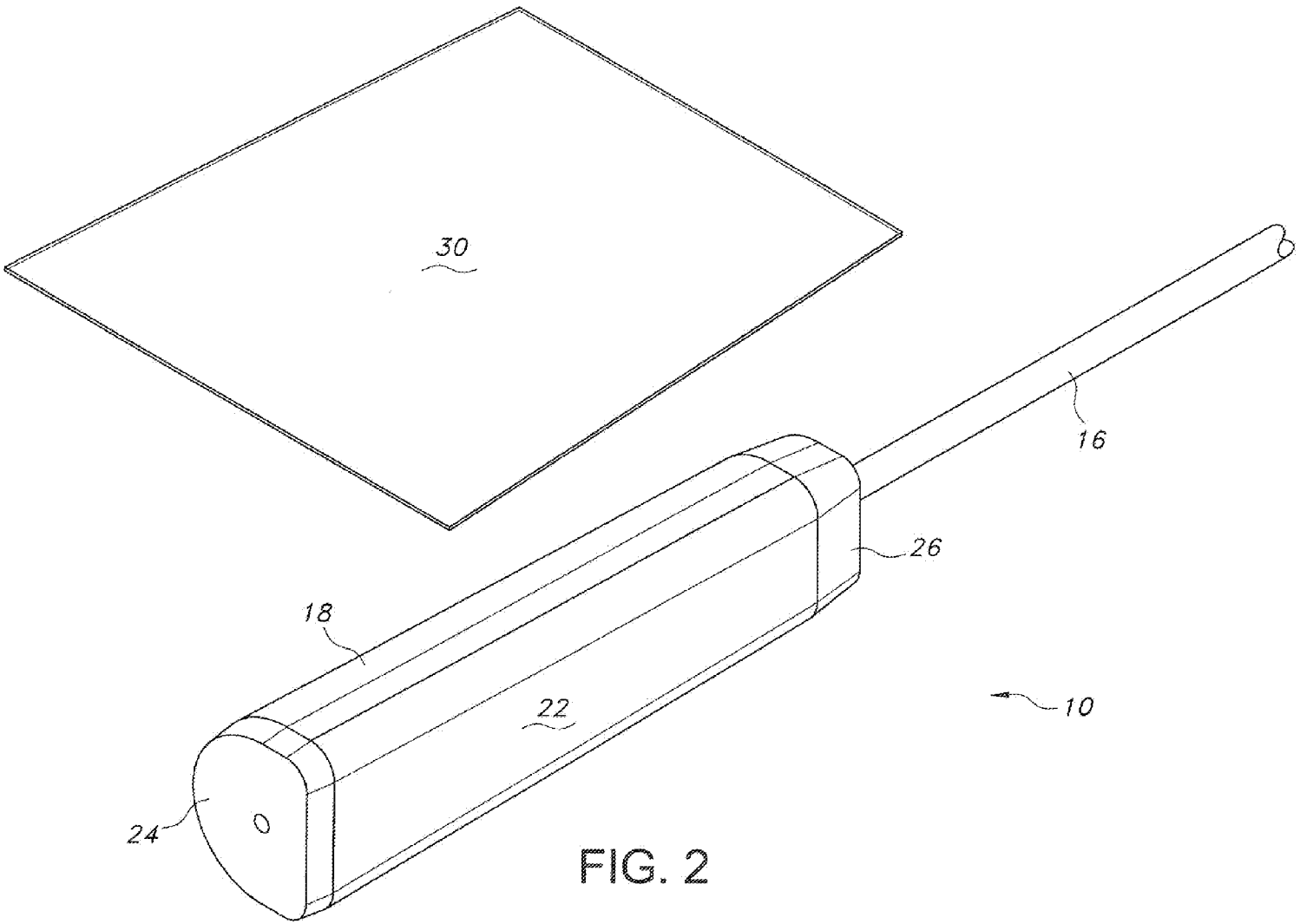
FIG. 2 shows a grip according to the present disclosure attached to a gripping end of a golf club shaft.

FIGS. 1 and 2 illustrate a golf club grip assembly 10 in accordance with the present invention. The grip assembly 10 includes a base element 12 defining a lumen 14 for receiving a gripping end portion 16 of a golf club shaft (see FIG. 2). As shown, the base element 12 is an elongate sleeve defining a hollow lumen 14 which is dimensioned to receive the gripping end portion 16 snugly therein. The contact between the base element 12 may be preserved by a friction or interference fit, may be supplemented by use of a suitable adhesive as is well known in this art, or may result from a combination thereof. As is known in the art, the base element may be fabricated of any suitable material, including without limitation rubber, silicon rubber, natural or synthetic polymers, natural or synthetic plastics, other suitable synthetic materials, and combinations thereof.

The assembly 10 further includes a first grip element 18 defining an open channel 20 for receiving the base element 12 and the gripping end 16. That open channel 20 extends axially along a longitudinal dimension of the first grip element 18, and typically has a width and a depth dimensioned to receive substantially an entirety of a thickness of the base element 12 and the gripping end portion 16. In the depicted embodiment, the first grip element 18 defines a substantially c-shaped figure. However, the skilled artisan will appreciate that other exterior configurations for the first grip element 18 are contemplated, according to the user's preference.

A second grip element 22 is provided, typically dimensioned to match a cross-sectional dimension and a longitudinal dimension of the first grip element 18. In the depicted embodiment, the second grip element 22 defines a substantially planar cover for capturing the base element 12 and the gripping end 16 between the first grip element 18 and the second grip element 22, thereby defining the exterior dimension of the grip assembly 10. As shown in the drawing figures, the assembled first grip element 18 and second grip element 22 define a substantially d-shaped grip assembly 10, providing a curved rear portion which nests into the users palms/fingers, and a substantially planar front portion on which the user's thumbs may rest. This exterior configuration assists in proper placement of the user's hands during a putting stroke.

Figures 3, 4A, 4B, 4C, 5A, 5B, 5C, 5D:
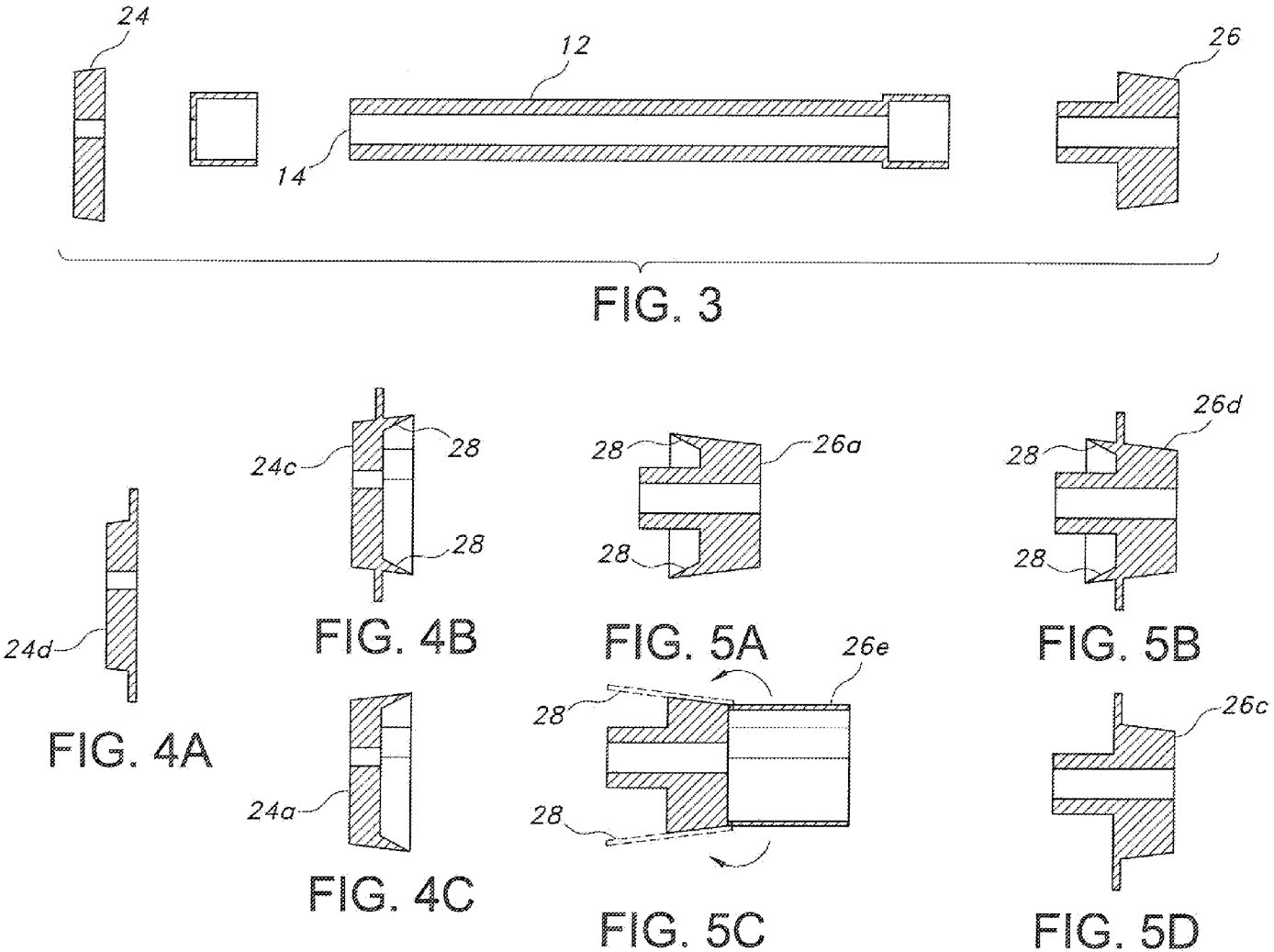
FIG. 3 is a side elevational view of an embodiment of the grip of FIG. 1.
FIGS. 4*a-c* show various embodiments of end cap elements according to the present disclosure.
FIGS. 5*a-d* show various embodiments of grip tip elements according to the present disclosure.

Desirably, an end cap 24 and a grip tip 26 are provided as elements of the grip assembly 10 (see FIGS. 1 and 3). The end cap 24 and grip tip 26 may be provided in any of a number of configurations, such as those shown in FIG. 1, FIGS. 4*a-c*, and FIGS. 5*a-d*. Other suitable configurations are contemplated. Desirably, the end cap 24 and grip tip 26 will include a lip or flange 28, the purpose of which will be described below.

With reference to FIG. 2, a wrapping element 30 may be provided for wrapping around the assembled grip assembly 10 as shown. The wrapping element 30, which may be fabricated of any suitable natural or synthetic material including without limitation synthetic leather, synthetic polymer sheets, thin elastomer sheets, thin thermoplastic elastomer sheets, and the like, is wrapped around the grip assembly 10 and secured in any suitable manner, such as by use of a suitable adhesive. The wrapping element 30 (with or without a backing comprising a man-made fabric, include woven or non-woven fabrics) further assists in maintaining the integrity of the grip assembly 10, protects the components of the grip assembly 10, and also provides the exterior look and feel of the club grip. The wrapping element 30 may be provided as a planar sheet as shown in FIG. 2, or alternatively may be provided as a spiral or ribbon wrap (not shown) as is known in this art field.

Once the wrapping element 30 is in place, the end cap 24 and grip tip 26 may be installed at opposed ends of the grip (see FIGS. 2 and 3) and secured by any desirable means, such as a friction or interference fit, a suitable adhesive, or both. The lip or flange 28 of the grip tip 26 and end cap 24 are disposed on an exterior surface of the wrapping element 30. The lip or flange 28 may be sufficiently stiff to slide over the top surface of the wrapping element 30, or alternatively may be sufficiently flexible to be flipped forward onto the top surface of the wrapping element 30 (see FIG. 5*c* as an example). In this manner, the distal ends of the wrapping element 30 are secured and protected, without requiring other materials such as a tape overwrap.

The first grip element 18 and second grip element 22 will typically be fabricated from any suitable natural or synthetic material (which may be made by any suitable chemical or mechanical means) providing the desired combination of size (i.e., large outer diameter) and light weight. Without intending any limitation, the first and second grip elements 18, 22 may be fabricated from one or more of open cell foams, a closed cell foams, polyurethane foams, silicon foams (formed by any suitable method, including without limitation chemical and mechanical means), and combinations thereof. Any suitable method for fabricating the first and second grip elements 18, 22 is contemplated, including without limitation molding, casting, blow molding, injection molding, extrusion molding, and the like. Once assembled, the gripping end 16, base element 12, first grip element 18, and second grip element 22 define an oversized, lightweight grip assembly 10, typically having a diameter between from about 14 mm to about 500 mm. The grip assembly 10 will typically have a weight of from about 45 grams to about 120 grams.

Figure 6:
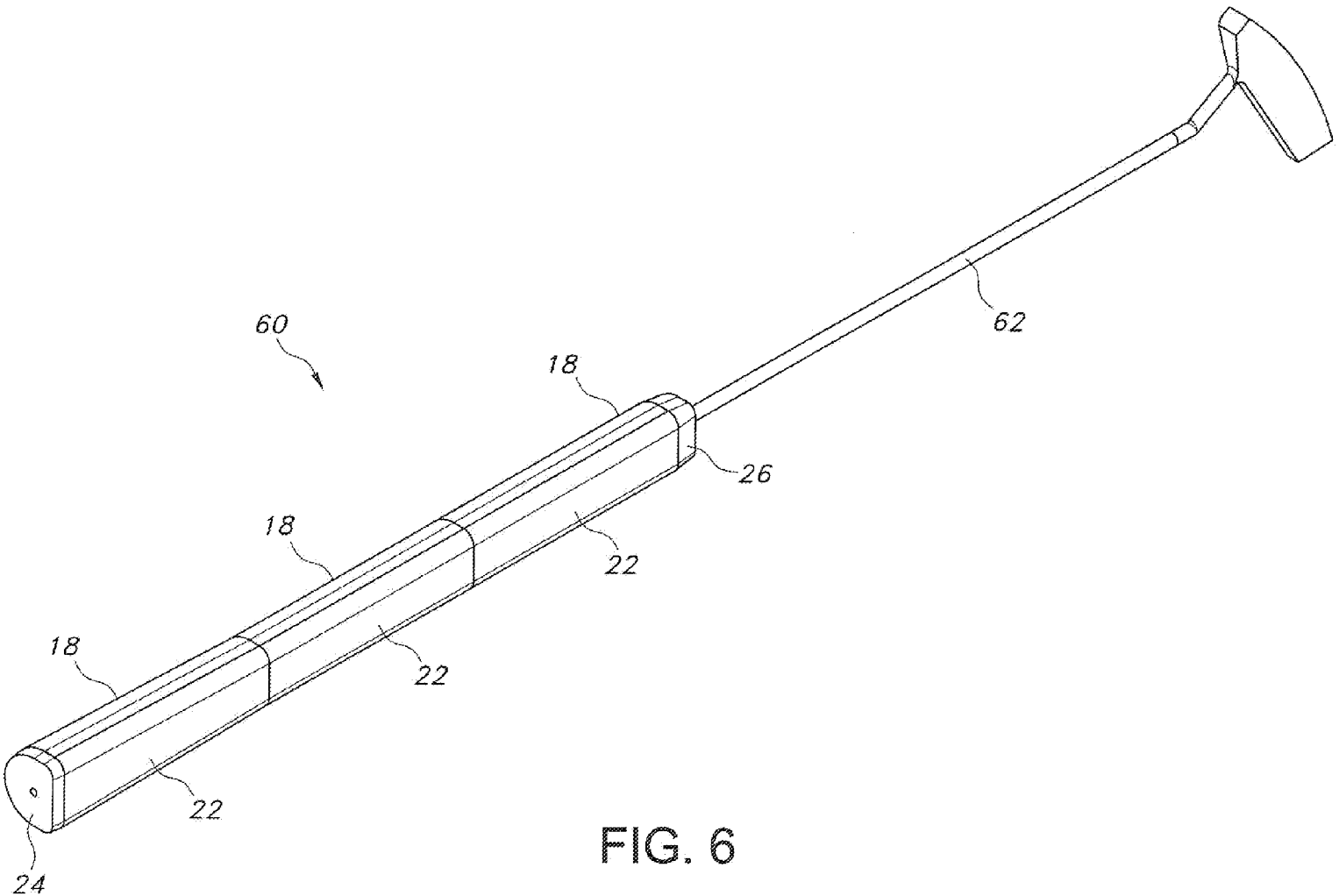
FIG. 6 shows a putter "long grip" according to the present disclosure. Reference will now be made in detail to the present preferred embodiment of the invention, an example of which is illustrated in the accompanying drawings.

Advantageously, the grip assembly 10 of the present disclosure may be adapted to form a putter "long grip" as is known in the art. This may be accomplished by simply providing the elements of the grip assembly 10 as described above, elongated to the desired length dimensions of the long grip. Alternatively, as shown in FIG. 6, a modular design for a long grip assembly 60 is provided. In particular, a plurality of base elements 12 (not shown for convenience in FIG. 6), a plurality of first grip elements 18, and a plurality of second grip elements 22 may be arrayed in sequence along a putter shaft 62. The various elements may be attached to the putter shaft 62, and to one another, by any suitable means such as an adhesive. As described above, an end cap element 24 and a grip tip element 26 may be provided. One or more wrapping elements 30 as described above (not shown in FIG. 6) may be provided to complete the assembly 60. The modular grip assembly 60, once assembled, will define an oversized long grip for a putter having a diameter between from about 14 mm to about 500 mm.

Accordingly, there is provided a lightweight, oversized grip assembly for a golf club such as a putter, which may be easily adapted to provide a putter "long grip" without unduly increasing club weight or affecting the balance and "feel" of the club. The grip is simple to manufacture, economical, and durable. In particular, the modular long grip assembly 60 as described herein provides a simple, economical means for fabricating a putter long grip, eliminating the need for special molds and/or tooling to provide the long grip. Rather, the manufacturer need only assemble multiple segments of a grip assembly 10 as described herein until a grip assembly 60 of a desired length is achieved, following by finishing the grip assembly 60 with a wrapping element 30. Of course, the length of the grip assembly 60 will be dictated by the putter type being provided. For example, a so-called "belly putter" will have a grip that is greater in length than a conventional short putter, but less in length than a long putter.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

What is claimed is:

1. A lightweight, oversized grip assembly for a golf club or other sporting equipment, comprising:

a base element defining a lumen for receiving a gripping end portion of a golf club or other sporting equipment;

a first grip element defining an open channel for receiving the base element and gripping end; and a second grip element dimensioned to match a cross-sectional dimension and a longitudinal dimension of the first grip element, being a substantially planar cover for said first grip element defining a substantially planar front surface to the assembled grip.

2. The grip assembly of claim 1, wherein the base element is an elongate sleeve defining a hollow lumen through a longitudinal dimension of the base element, said lumen dimensioned to receive the gripping end snugly therein.

3. The grip assembly of claim 2, wherein the base element is fabricated from the group of materials consisting of a rubber, a silicon rubber, a natural or a synthetic polymer, a natural or a synthetic plastic, and combinations thereof.

4. The grip assembly of claim 1, wherein the first grip element defines an open channel axially along a longitudinal dimension thereof, the open channel having a width and a depth dimensioned to receive substantially an entirety of a thickness of the base element and the gripping end.

5. The grip assembly of claim 4, wherein the first grip element is fabricated from the group of materials consisting of an open cell foam, a closed cell foam, a polyurethane foam, a silicon foam, and combinations thereof.

6. The grip assembly of claim 1, wherein the second grip element defines the substantially planar cover for capturing the base element and the gripping end between the first grip element and the second grip element.

7. The grip assembly of claim 6, wherein the second grip element is fabricated from the group of materials consisting of an open cell foam, a closed cell foam, a polyurethane foam, a silicon foam, and combinations thereof.

8. The grip assembly of claim 1, wherein the assembled gripping end, base element, first grip element, and second grip element define a grip having a maximum diameter of from about 14 mm to about 500 mm.

9. The grip assembly of claim 1, further including at least one wrapping element for wrapping around the assembled gripping end, base element, first grip element, and second grip element.

10. The grip assembly of claim 9, further including an end cap element and a grip tip element, said end cap element and grip tip element each including a lip or flange for disposing on a portion of an outer surface of the wrapping element.

11. A modular, lightweight, elongated, and oversized grip assembly for a putter, comprising:

a plurality of base elements defining a lumen for receiving a gripping end portion of a putter;

a plurality of first grip elements defining an open channel for receiving the plurality of base elements and the gripping end; and a plurality of second grip elements dimensioned to match a cross-sectional dimension and a longitudinal dimension of the plurality of first grip elements, in combination providing a substantially planar cover for said first grip elements and defining a substantially planar front surface to the assembled grip;

wherein when assembled, the plurality of base elements, plurality of first grip elements, and plurality of second grip elements define an elongated grip for the putter having a maximum diameter of from about 14 mm to about 500 mm.

12. The modular grip assembly of claim 11, wherein the plurality of base elements are elongate sleeves defining hollow lumens along a longitudinal dimension of the base elements, said lumens dimensioned to receive the putter gripping end snugly therein.

13. The modular grip assembly of claim 12, wherein the plurality of base elements are fabricated from the group of materials consisting of a rubber, a silicon rubber, a natural or a synthetic polymer, a natural or a synthetic plastic, and combinations thereof.

14. The modular grip assembly of claim 11, wherein the plurality of first grip elements each define an open channel axially along a longitudinal dimension thereof, the open channel having a width and a depth dimensioned to receive substantially an entirety of a thickness of the plurality of base elements and the putter gripping end.

15. The modular grip assembly of claim 14, wherein the plurality of first grip elements are fabricated from the group of materials consisting of an open cell foam, a closed cell foam, a polyurethane foam, a silicon foam, and combinations thereof.

16. The modular grip assembly of claim 11, wherein the plurality of second grip elements each define the substantially planar cover for capturing the plurality of base elements and the putter gripping end between the plurality of first grip elements and the plurality of second grip elements.

17. The modular grip assembly of claim 16, wherein the plurality of second grip elements are fabricated from the group of materials consisting of an open cell foam, a closed cell foam, a polyurethane foam, a silicon foam, and combinations thereof.

18. The modular grip assembly of claim 11, further including at least one wrapping element for wrapping around the assembled gripping end, plurality of base elements, plurality of first grip elements, and plurality of second grip elements.

19. The modular grip assembly of claim 18, further including an end cap element and a grip tip element, said end cap element and grip tip element each including a lip or flange for disposing on a portion of an outer surface of the wrapping element.

* * * * *